US010285517B2

(12) United States Patent
Heiman et al.

(10) Patent No.: US 10,285,517 B2
(45) Date of Patent: May 14, 2019

(54) SIMULATED DUVET COVER SYSTEM

(71) Applicant: Standard Textile Co., Inc., Cincinnati, OH (US)

(72) Inventors: Kim Heiman, Cincinnati, OH (US); Richard Stewart, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 356 days.

(21) Appl. No.: 15/223,025

(22) Filed: Jul. 29, 2016

(65) Prior Publication Data

US 2018/0027998 A1 Feb. 1, 2018

(51) Int. Cl.

| | |
|---|---|
| ***A61G 9/02*** | (2006.01) |
| ***A47G 9/02*** | (2006.01) |
| *A47G 9/00* | (2006.01) |

(52) U.S. Cl.

CPC ..... *A47G 9/0207* (2013.01); *A47G 9/0223* (2013.01); *A47G 2009/004* (2013.01)

(58) Field of Classification Search

CPC ..... A47G 9/02
USPC ..... 5/502, 494, 496–497
See application file for complete search history.

(56) References Cited

U.S. PATENT DOCUMENTS

| | | | | |
|---|---|---|---|---|
| 4,903,361 | A * | 2/1990 | Tang | A47G 9/02 5/500 |
| 6,032,308 | A * | 3/2000 | Chuang | A47G 9/0261 5/413 AM |
| 8,689,375 | B2 | 4/2014 | Stinchcomb | |
| 2005/0144721 | A1 | 7/2005 | Linnane | |
| 2014/0157575 | A1 | 6/2014 | Stinchcomb | |

(Continued)

FOREIGN PATENT DOCUMENTS

| | | | |
|---|---|---|---|
| DE | 3738397 | A1 | 7/1988 |
| DE | 202005002388 | U1 | 7/2005 |
| FR | 2868274 | A1 | 10/2005 |

(Continued)

OTHER PUBLICATIONS

International Searching Authority, Search Report and Written Opinion issued in International Applicaiton No. PCT/US2017/044673 dated Nov. 24, 2017 (14 pages).

(Continued)

*Primary Examiner* — Fredrick C Conley
(74) *Attorney, Agent, or Firm* — Wood Herron & Evans LLP

(57) ABSTRACT

A simulated duvet cover system provides an easily-assembled multi-layer construction in which first and second cover layers formed by fabric sheets are removably coupled to an intermediate layer defined by a blanket or comforter and sandwiched between the cover layers. Each of the first and second cover layers is separately coupled to the intermediate layer using respective first and second fastening elements, which may include snaps, hook and loop fasteners, magnets, and the like. The coupling may be limited to being at the corner portions and along one of four side/end edges of the layers to promote quick and easy removal of the cover layers when those require cleaning. The cover layers are sized such that portions of these cover layers overlie or cover up the fastening elements when the cover system is assembled on a bed, thereby providing a similar appearance to a conventional duvet cover.

19 Claims, 9 Drawing Sheets

(56) References Cited

U.S. PATENT DOCUMENTS

| | | | |
|---|---|---|---|
| 2015/0157147 | A1 | 6/2015 | Haraszta |
| 2017/0071368 | A1 | 3/2017 | Pelaez |

FOREIGN PATENT DOCUMENTS

| | | | |
|---|---|---|---|
| GB | 2272639 | A | 5/1994 |
| GB | 2389523 | A | 12/2003 |
| GB | 2415371 | A | 12/2005 |
| JP | 2002325668 | A | 11/2002 |
| JP | 2003116693 | A | 4/2003 |
| WO | 2010022446 | A1 | 3/2010 |

OTHER PUBLICATIONS

International Searching Authority, Written Opinion issued in International Applicaiton No. PCT/US2017/044647 dated Aug. 21, 2018 (6 pages).

International Searching Authority, Search Report and Written Opinion issued in International Applicaiton No. PCT/US2017/044647 dated Nov. 2, 2017 (16 pages).

* cited by examiner

SIMULATED DUVET COVER SYSTEM

TECHNICAL FIELD

The present invention relates generally to linens used with bedding and, more specifically, to cover systems used with bedding in various contexts.

BACKGROUND

Blankets and comforters, such as down comforters, provide an extra layer of comfort and warmth to those who choose to use them while sleeping. For example, a down comforter provides more warmth and comfort as compared to sleeping under only a top sheet of a sheet set applied to a bed. However, because of the bulk/size of comforters and blankets, they can be very difficult to properly clean. In order to diminish the need for direct cleaning and extend the life thereof, these blankets and comforters are often covered with (and/or inserted within) what is known as a duvet cover. The duvet cover protects the blanket or comforter while, at the same time, contributes an aesthetically appealing element to the bed when positioned atop the bed. When used in place of a top sheet, as many persons choose to do, the duvet cover is in regular contact with the human body and therefore should be cleaned on a regular basis. This cleaning necessitates removal of the duvet cover from the blanket or comforter.

One conventional version of a duvet cover 300 is shown in FIG. 10. The duvet cover 300 is defined by a top panel 302 of fabric material and a bottom panel 304 of fabric material which are generally permanently coupled together, such as by stitching, along a first portion 306 of the periphery thereof, and which define an opening 308 along a second portion 310 of the periphery thereof. This opening 308 may be permanently open, or in some embodiments, the opening 308 may be selectively closed by a connection mechanism such as the zipper 312 shown in FIG. 10. The filler 314, in the form of a blanket or comforter, is pushed through the opening 308 to be sandwiched between the top and bottom panels 302, 304, in a similar fashion as inserting a pillow into a pillowcase. However, unlike a pillow, the filler 314 is substantially large in size and capable of bunching up or folding over itself when being inserted into the duvet cover 300 through the opening 308. This can cause significant difficulties and delays when an operator tries to properly position the filler 314 within the duvet cover 300. Likewise, removing the large filler 314 from within the duvet cover 300 can also be difficult and time-consuming. Even when connection mechanisms such as the zipper 312 are provided to widen the opening 308, these difficulties still exist, and moreover, the zipper 312 is prone to defective operations as well.

These deficiencies are exacerbated in commercial contexts such as hotels and hospitals, where bedding materials can require washing every day, in some circumstances. Conventional duvet covers therefore do not find as significant of use as would be expected in places like hotels, as a result of complications resulting from the potential need to remove and replace a duvet cover on a plurality of beds every single day of operation. Accordingly, bedding options and decorative options that can be offered to guests and patients are reduced in these fields.

It would be desirable, therefore, to provide a new duvet cover or similar system which addresses these and other drawbacks of conventional designs of duvet covers like the one shown in FIG. 10.

SUMMARY

In one embodiment, a simulated duvet cover system is provided for covering a bed. The system includes a first cover layer defined by a first fabric sheet and a second cover layer defined by a second fabric sheet. An intermediate layer is defined by at least one of a blanket and a comforter and is configured to be sandwiched between the first and second cover layers. The system further includes first fastening elements located at the first cover layer and the intermediate layer for removably coupling these elements to one another. Second fastening elements are located at the second cover layer and the intermediate layer for removably coupling these elements to one another. The first and second cover layers are thus configured to be removed (and replaced) easily for cleaning separate from the intermediate layer. Additionally, the first cover layer, which is located atop the other layers when in use, is larger in size than each of the intermediate layer and the second cover layer such that intersections of the layers at the first and second fastening elements are hidden from view when the cover system is fully assembled and spread on top of a bed. The simulated duvet cover therefore simulates the appearance of a conventional duvet cover when laid out on a bed despite the different construction compared to those conventional designs.

Each of the first cover layer, the second cover layer, and the intermediate layer includes a head end edge, a foot end edge, and first and second side edges extending between the head end edge and the foot end edge. As a result of the larger size of the first cover layer, this layer projects outwardly beyond the intermediate layer and the second cover layer at the foot end edges and at the first and second side edges. This projection covers the appearance of multiple layers sandwiched together as well as any view of the fastening elements along those edges, to thereby provide the appearance of a conventional duvet cover as set forth above. By contrast, the second cover layer includes a flap portion at the head end edge thereof which projects outwardly beyond the intermediate layer and also beyond the first cover layer, so as to extend around these layers and hide from view the intersections of the layers and the fastening elements at the head end edges.

In one aspect, the assembly of the layers in the simulated duvet cover system is made simple and quick by connecting the each of the first and second cover layers to the intermediate layer at only selected locations, such as at four corner portions defined by the layers, as well as along the head end edges. As a result of the different projections and sizing of the layers at the edges, the first and second cover layers are fastened to opposite sides of the intermediate layer along two of the corner portions, while the first and second cover layers are fastened to the same side of the intermediate layer along the other two of the corner portions, as well as along the corresponding head end edges. Even though the first and second cover layers are not directly coupled to one another in such an arrangement, the intermediate layer defining a blanket or comforter is securely held sandwiched between the first and second cover layers as a result of just these fastenings at selected locations. Accordingly, the assembly and removal process for layers when cleaning is required becomes a rapid process that readily enables use of these systems in commercial contexts as well as for personal, residential use.

The fastening elements that couple the various layers of the simulated duvet cover system together may define one of many different types of known fasteners which are quick and simple to operate. In one example, the first and second fastening elements may be defined by snaps, and the snaps may be color coded or otherwise visibly/tactilely differentiated so that the first fastening elements and the second fastening elements do not get accidentally coupled to one another during assembly of the system. Other types of fastening elements that may be used in other embodiments include magnets and hook and loop fasteners, among others. The important functionality is that the fastening elements be reusable after cleaning of the cover layers has occurred. The first cover layer may define a decorative pattern, and it will be understood that different cover layers may be used with a system to provide different desired aesthetic appearances for a bed.

In accordance with another embodiment, a method is provided for covering a bed with a simulated duvet cover system. The method begins with laying a second cover layer onto the bed, and then laying an intermediate layer defined by at least one of a blanket and comforter on top of the second cover layer. Second fastening elements located at the second cover layer and the intermediate layer are used to removably couple these layers to one another. The method also includes laying a first cover layer on top of the intermediate layer, with the first cover layer being larger in size than the other two layers. First fastening elements located at the first cover layer and the intermediate layer are then used to removably couple those layers together. Consequently, the simulated duvet cover system is quickly and easily assembled onto a bed and provides the appearance of a conventional duvet cover, despite the significantly different construction and assembly thereof. Furthermore, the first and second cover layers can be defined by fabric sheets which are configured to be removed for cleaning separate from the intermediate layer.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention.

DETAILED DESCRIPTION

Figure 1:
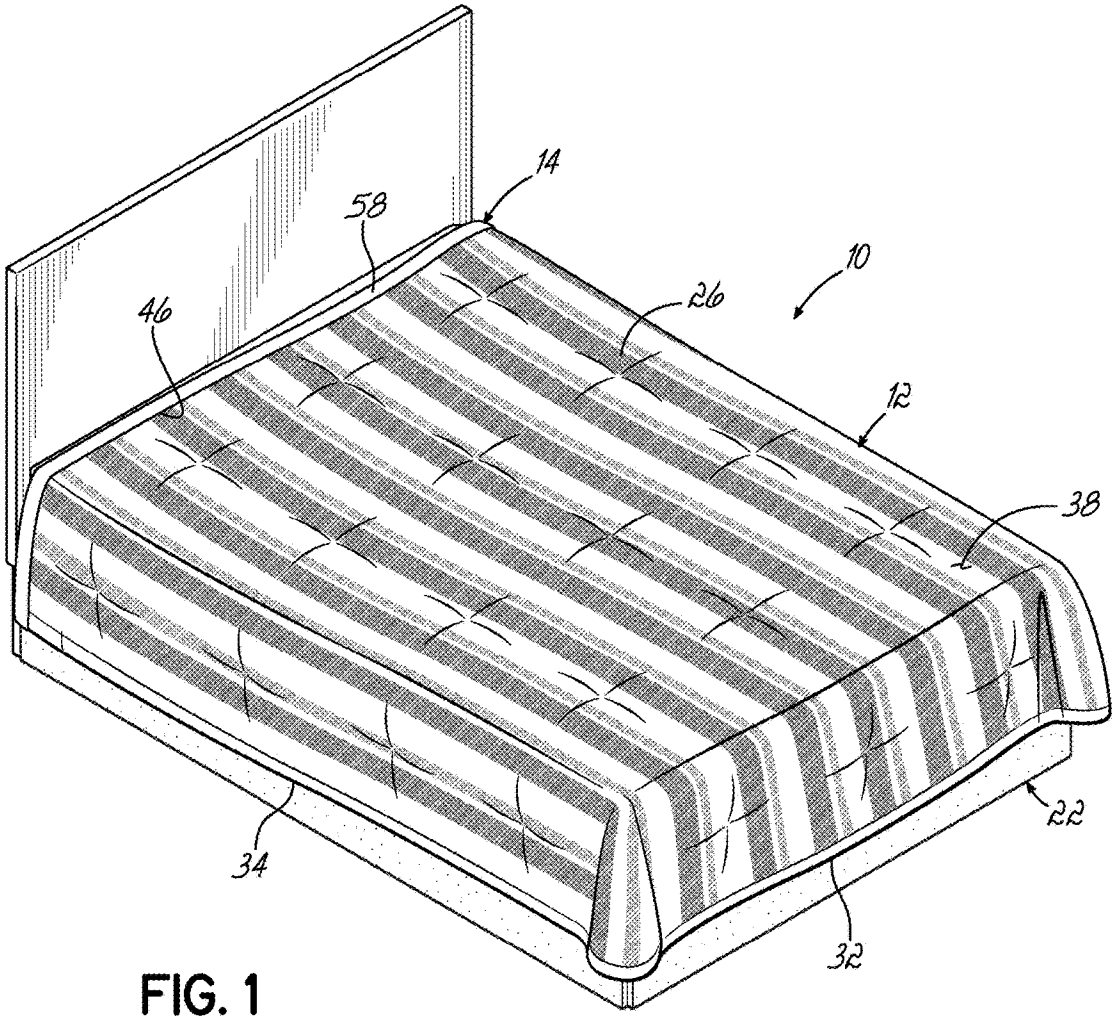
FIG. 1 is a top perspective view of a simulated duvet cover system, in accordance with an embodiment of the invention, and shown in the fully assembled state while spread over a bed.
Figure 10:
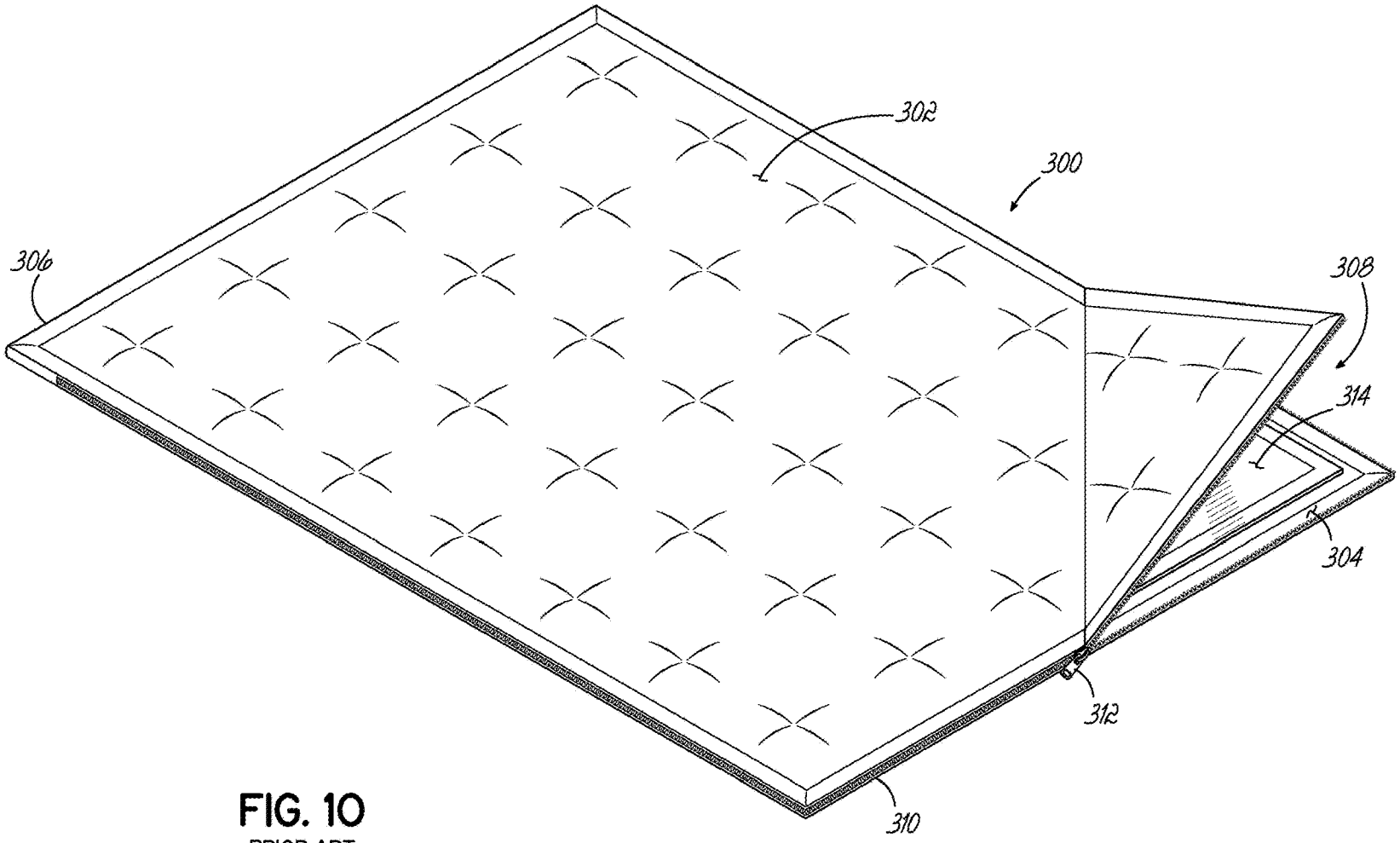
FIG. 10 PRIOR ART
FIG. 10 is a top perspective view of a conventional duvet cover having a closure zipper and a blanket or comforter within the duvet cover.

FIGS. 1 through 7 show a simulated duvet cover system 10 in accordance with one embodiment of the invention. As revealed most clearly in FIGS. 2 through 7, the system 10 includes three separate pieces in the form of a first cover layer 12, a second cover layer 14, and an intermediate layer 16 (defined by a blanket or comforter) that are assembled together to simulate the performance, functionality, and general external appearance of a conventional duvet cover (such as the duvet cover 300 described above and shown in FIG. 10). Advantageously, these layers 12, 14, 16 are configured for quick and easy assembly together as a result of first fastening elements 18 and second fastening elements 20 which connect the intermediate layer 16 to each of the first and second cover layers 12, 14. Thus, unlike the conventional duvet cover, the exterior layers (the first and second cover layers 12, 14) are readily removable and replaceable when cleaning is needed. As such, the system 10 allows for the appearance and functionality of a blanket/comforter and duvet cover to be used in contexts where frequent cleaning and washing is required, including but not limited to hotels and hospitals. Moreover, even though the first and second fastening elements 18, 20 are configured for rapid assembly and disassembly of the layers 12, 14, 16, the system 10 is designed to hide the appearance of those first and second fastening elements 18, 20 when the system 10 is fully assembled and spread on a bed 22 as shown in FIG. 1, thereby making the system 10 desirable for customers and users in all contexts where such a type of bedding and cover is desirable. These and other beneficial features and functionality of the system 10 are described in detail below.

Use of several descriptive terms, such as top, bottom, head, foot, side, horizontal, and/or vertical, for example, as it pertains to/describes the simulated duvet cover system 10 and its components, is from the viewpoint of when the system 10 is laid out on a bed 22, unless otherwise noted.

Figure 2:
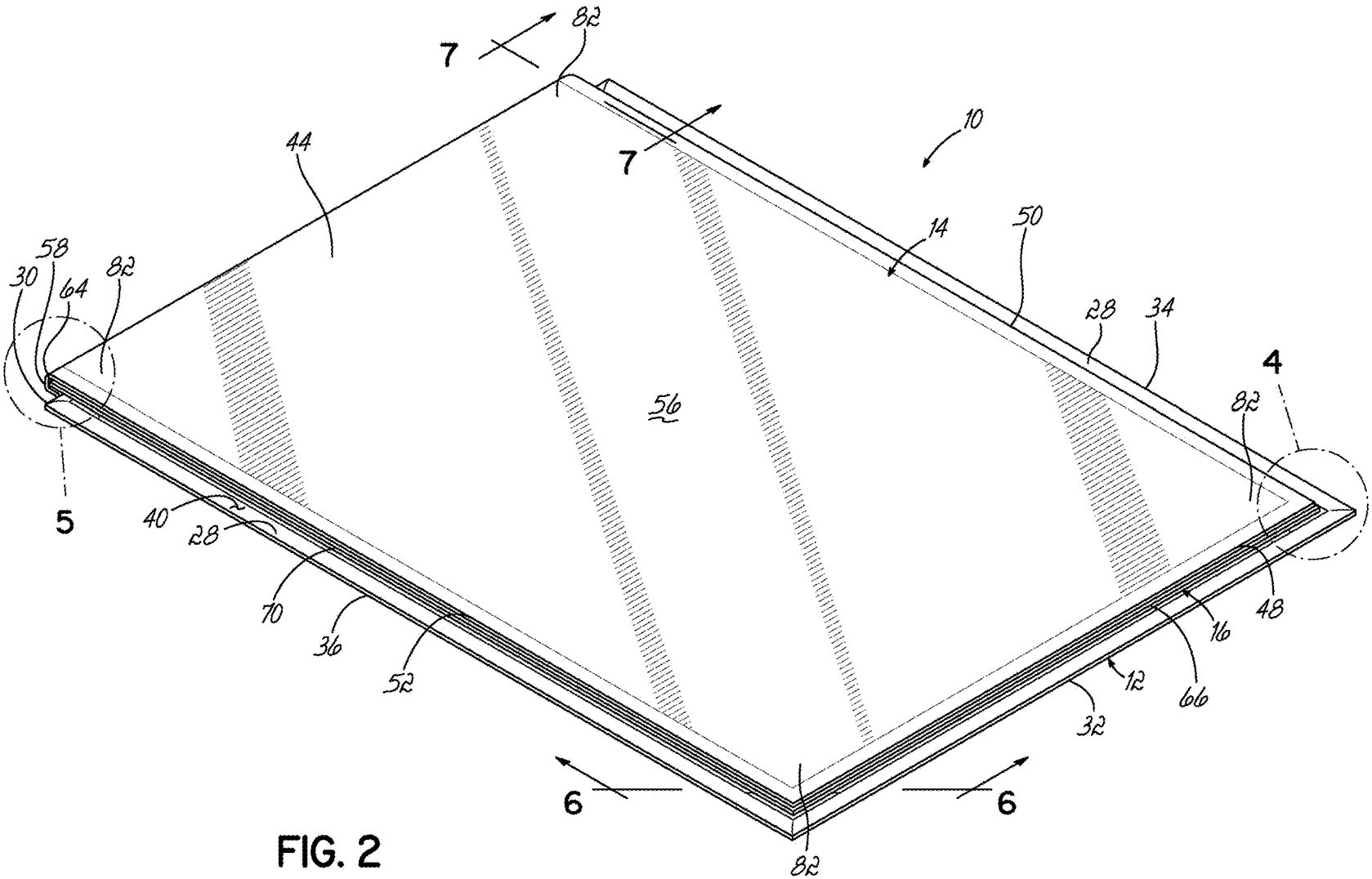
FIG. 2 is a bottom perspective view of the simulated duvet cover system of FIG. 1, with the system laid out in a completely horizontal orientation.
Figure 3:
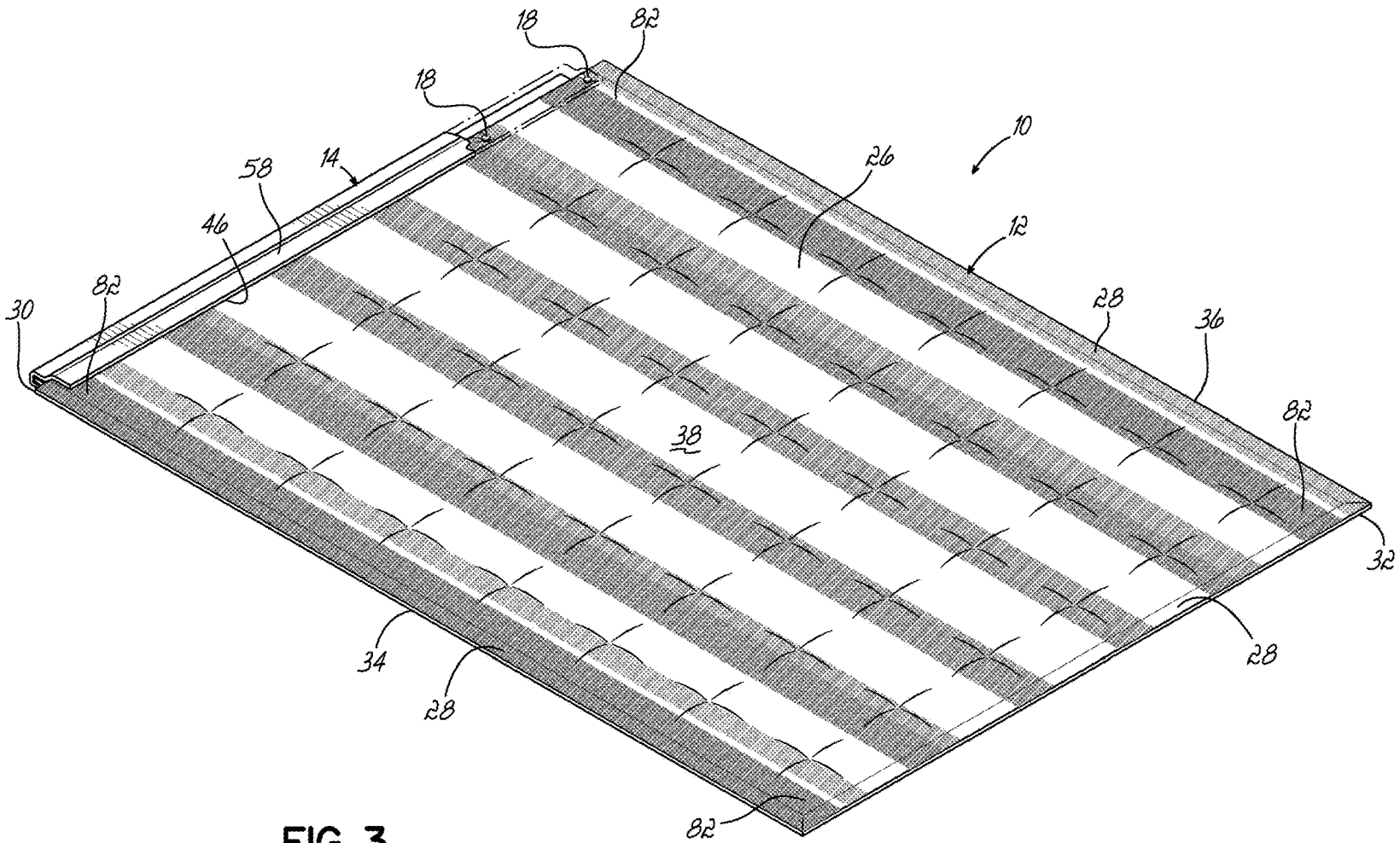
FIG. 3 is a top perspective view of the simulated duvet cover system of FIG. 1, with the system laid out in a completely horizontal orientation, with a portion of a second cover layer shown in phantom adjacent a head end edge to reveal additional features.

With specific reference to FIGS. 1 through 3, the system 10 is shown in further detail in accordance with one embodiment of the invention. Beginning with the first cover layer 12, which is shown most clearly at FIG. 3, a first fabric sheet 26 defines this first cover layer 12. As a result, the first cover layer 12 defines a small thickness relative to the lateral dimensions of width and length which are visible when viewing the first cover layer 12 from the top as in FIG. 3.

The first fabric sheet 26 may be generally a single layer of fabric across the majority of the surface area defined by the first cover layer 12, although multi-layer construction is also possible in other embodiments. However, the first fabric sheet 26 is folded over itself and stitched together (or otherwise secured using skills known in the fabrics art) to form a double fabric sheet layer 28 around the outer periphery of the first cover layer 12, which allows for advantageous placement of some of the first fastening elements 18 in a location hidden from view at the top as set forth below.

The outer periphery of the first cover layer 12 is defined by a head end edge 30, a foot end edge 32, and first and second side edges 34, 36 which each extends between the head end edge 30 and the foot end edge 32. As will be readily understood from FIG. 1, the head end edge 30 is configured to extend along a head end of bed 22 when the system 10 is placed on the bed 22, while the foot end edge 32 is configured to extend along a foot end of the bed 22 in the same circumstance. As most easily seen in the bottom perspective view at FIG. 2, the first cover layer 12 projects a small distance beyond the corresponding edges of the intermediate layer 16 and the second cover layer 14 at each of the foot end edge 32 and the first and second side edges 34, 36 of this embodiment. These further projections cover the interface between all of the layers 12, 14, 16 when the system 10 is placed on a bed 22 as shown in FIG. 1, and also make the first cover layer 12 larger in cross-sectional size than the other layers 14, 16. The first cover layer 12 also includes a top surface 38 which faces outwardly or upwardly when the system 10 is assembled and laid on the bed 22, and a bottom surface 40 (visible in FIGS. 4 and 5, for example) facing downwardly towards the intermediate layer 16 when the system 10 is assembled. As shown in this embodiment, the top surface 38 of the first cover layer 12 may include a decorative pattern that adds a desirable or specific aesthetic look when covering the bed 22. The decorative pattern may be applied to the first fabric sheet 26 by any known method, including dyeing, printing, and the like. Furthermore, the decorative pattern may define any color and sequence as desired by the end user of the simulated duvet cover system 10.

Turning to the second cover layer 14, this element of the simulated duvet cover system 10 is shown most clearly in FIG. 2. The second cover layer 14 is defined by a second fabric sheet 44 in a similar manner as the first fabric sheet 26 of the first cover layer 12. In this regard, the second cover layer 14 also defines a small thickness relative to its lateral width and length, and the second fabric sheet 44 may be mostly a single layer except around the outer periphery, where folded back and stitched portions define double fabric sheet layers 28 as shown. Also similar to the first cover layer 12, the second cover layer 14 of this embodiment includes each of the following elements: a head end edge 46, a foot end edge 48, first and second side edges 50, 52, a top surface 54, and a bottom surface 56. The head end edge 46 of the second cover layer 14 extends generally along and parallel to the head end edge 30 of the first cover layer 12, and the other edges follow this same general pattern. The top surface 54 of the second cover layer 14 faces towards the intermediate layer 16 when the system 10 is fully assembled, while the bottom surface 56 faces towards the bed 22 and may come into contact with persons in the bed 22. Hence, the second cover layer 14 may require frequent or regular cleaning that is enabled by the quick and easy assembly and disassembly of the system 10 set forth below.

The second cover layer 14 projects beyond the intermediate layer 16 and the first cover layer 12 at the head end edge 46. More particularly, the second cover layer 14 of this embodiment further includes a flap portion 58 that both defines the head end edge 46 of the second cover layer 14 and wraps around each of the first cover layer 12 and intermediate layer 16 as shown in FIGS. 2 and 3. The flap portion 58 is therefore visible at the top of the system 10 after full assembly as shown in FIGS. 1 and 3. The flap portion 58 is positioned to cover and/or hide the intersection of the layers 12, 14, 16 along the head end of the bed 22, while also covering the fastening elements as well. For example, some of the first fastening elements 18 located in the first cover layer 12 are revealed when pulling back this flap portion 58, as indicated by a portion of the flap portion 58 shown in phantom in FIG. 3 for clarity. The flap portion 58 also enables the first and second cover layers 12, 14 to directly couple with the same side of the intermediate layer 16 as described with respect to FIG. 5 below. Accordingly, the intermediate layer 16 projects slightly beyond the first cover layer 12 at the head end in order to allow for space on the same side to couple to both of the first and second cover layers 12, 14, which is shown in FIGS. 2 and 3 but also described and shown further below with reference to FIGS. 5 and 7.

In addition to the functional benefits of providing the flap portion 58 on the second cover layer 14 as described above, the wrap around of the flap portion 58 also allows the system 10 to maintain the appearance of a conventional duvet cover in other typical circumstances beyond FIG. 1 of how the system 10 is laid out on the bed 22. To this end, users will often fold down or back a portion of the duvet cover at the head end when it is not desired to put the pillows on top of the duvet cover. As shown in FIG. 2, if this type of fold back were applied without the flap portion 58, the intersection of the layers 12, 14, 16 would be clearly visible at this fold back in the same manner as shown at the foot end edges 32, 48 of FIG. 2. Such intersections are covered up even in the folded back state by the flap portion 58, thereby maintaining the desired standard duvet cover appearance regardless of which normal way a user places and lays out the system 10 on the bed 22.

It will be understood that in alternative embodiments of the simulated duvet cover system, the flap portion may instead be provided on a portion of the first (or top) cover layer such that the top cover layer wraps around the intersection of layers in circumstances where the fold down or back at the head end of the bed is not typically used. In still further alternatives, the flap portion may be omitted such that the first cover layer is larger and projects beyond the other layers at all edges thereof. Regardless of the particular arrangement or omission of a flap portion, the simulated duvet cover system in accordance with this invention continues to provide the functionality of presenting the appearance of a conventional duvet cover while being much simpler and quicker to assemble together to cover a bed.

The first and second fabric sheets 26, 44 defining the first and second cover layers 12, 14 can be constructed of various fabrics such as conventional materials that are typically used in the construction of sheets and similar bedding materials. Fabric construction can be woven, non-woven, or knitted. In one example, the fabric construction is a woven plain weave. The fabric can include natural and/or synthetic fibers and may be lint free, as desired. In one example, the fabric includes polyester, polypropylene, and/or cotton. In another example, the fabric is substantially polyester, substantially cotton, or a polyester/cotton blend (e.g., a 50/50 or other specialized mixtures or weaves as commercially available from Standard Textile Co., Inc., the assignee of this application). The fabric also may incorporate additional elements such as, but not limited to: ESD (electrostatic dissipative)/anti-static yarns, including nylon or carbon fibers, and the like; liquid resistant material, such as polyester or polypropylene; liquid resistant coatings or finishes that conform to at least minimum standards established for Level 1 classification by AAMI PB70 Standard, such as a fluorocarbon based finish; and/or an antimicrobial finish. These additional elements can comprise about 1% of the total material of the system 10, but may be provided in a greater or lesser amount as desired. These are but some examples of the materials that can be used to form the first and second cover layers 12, 14 of the system 10.

Now turning to the intermediate layer 16, this element of the simulated duvet cover system 10 is visible at FIG. 2 as well as in part at FIGS. 4 through 7. The intermediate layer 16 is defined by a blanket or comforter 62 or the like, which is configured to provide a thickened layer of insulating filler which insulates the bed 22 and persons under the system 10 from the external environment about the bed 22. In this regard, the intermediate layer 16 is sandwiched between the first and second cover layers 12, 14 and also typically defines a larger thickness than either of the first and second cover layers 12, 14 (the intermediate layer 16 can be tapered in thickness adjacent its periphery and edges and so appears to be similar in thickness in FIGS. 1 through 5, but an example of the larger thickness is clearer in FIGS. 6 and 7). Similar to the first and second cover layers 12, 14, the intermediate layer 16 of this embodiment includes each of the following elements: a head end edge 64, a foot end edge 66, first and second side edges 68, 70, a top surface 72, and a bottom surface 74. The head end edge 64 of the intermediate layer 16 extends generally along and parallel to the head end edge 30 of the first cover layer 12, and the other edges follow this same general pattern. The top surface 72 of the intermediate layer 16 faces towards the first cover layer 12 when the system 10 is fully assembled, while the bottom surface 74 faces towards the second cover layer 14 when fully assembled.

The intermediate layer 16 is substantially the same lateral (width and length) size as the second cover layer 14, as evidenced most clearly in FIG. 2. For example, the foot end edge 66 of the intermediate layer 16 extends adjacent to the foot end edge 48 of the second cover layer 14, and the same is true of the corresponding first side edges 50, 68 and the corresponding second side edges 52, 70 when the system 10 fully assembled in this embodiment. The intermediate layer 16 at the head end edge 64 thereof extends or projects slightly beyond the head end edge 30 of the first cover layer 12, primarily for the purposes of providing space on the intermediate layer 16 where the second fastening elements 20 can be placed for connection to the second cover layer 14 where it wraps around at the flap portion 58. This arrangement is most clear in the illustrations of FIGS. 5 and 7 (but it is also visible in part in FIGS. 2 and 3 as well), described further below with respect to the fastening together of the layers 12, 14, 16 to produce the system 10. Advantageously, the intermediate layer 16 is substantially enclosed and effectively hidden from view when the simulated duvet cover system 10 is in normal use, as shown at FIG. 1 for example. Of course, it will be appreciated that the particular size and shape (including the shape of the periphery of layers 12, 14, 16, which is rectangular in the illustrated embodiment) of these elements of the system 10 may be modified in other embodiments to match beds of corresponding shapes and sizes without departing from the scope of the invention.

The intermediate layer 16 defined by the blanket or comforter 62 may be comprised of similar fabric materials as described above, as well as of various fillers as well known in the art of bedding and blanket materials. As long as the intermediate layer 16 is formed independently from the first and second cover layers 12, 14 and is provided with the corresponding first and second fastening elements 18, 20 for the removable couplings, the specific materials chosen will not affect the principal beneficial functionalities of the simulated duvet cover system 10, which are discussed throughout this application.

Having described the general elements and construction of the layers 12, 14, 16 combined to form the simulated duvet cover system 10 of this embodiment, reference is now given to FIGS. 4 through 7 and the first and second fastening elements 18, 20 used to couple the layers 12, 14, 16 together. In this embodiment, the first and second fastening elements 18, 20 are defined by snaps 80 including first and second portions (also often referred to as male and female portions) which removably engage with one another in a frictional engagement. For example, the snaps 80 may be made of metal, plastic, and the like, and one of the portions [80*a* in FIGS. 6 and 7] of the snaps 80 may include an annular projection which frictionally seats within an annular recess formed in the other portions [80*b* in FIGS. 6 and 7] of the snaps 80, this engagement shown schematically in the cross-sections of FIGS. 6 and 7. Optional reinforcement tabs (not shown), such as twill tape, can be secured to the layers 12, 14, 16 also by techniques known in the art, such as by being sewn, to create a reinforced base for the snap 80 with the snap 80 being secured thereon. Alternately, the snap 80 may be reinforced by self-fabric gathered or pinched in the attachment operation. Other known configurations of snaps may also be used without departing from the scope of the invention.

Advantageously, the snaps 80 defining the first and second fastening elements 18, 20 are located only at certain limited positions on each of the first and second cover layers 12, 14 and the intermediate layer 16, thereby reducing the total number of assembly points needed when assembling the simulated duvet cover system 10. In the embodiment shown in FIGS. 1 through 7, the system 10 defines four corner portions 82 at intersections of the corresponding side edges 34, 36, 50, 52, 68, 70 of the layers with the head end edges 30, 46, 64 and with the foot end edges 32, 48, 66 of those same layers, and the first and second fastening elements 18, 20 are located at only those four corner portions 82 as well as along the head end edges 30, 46, 64 of the layers. This arrangement of the first and second fastening elements 18, 20 allows for rapid assembly of the first and second cover layers 12, 14 with the intermediate layer 16, while also assuring that the system 10 remains fully assembled during normal use on the bed 22. To this end, the positive coupling of the intermediate layer 16 to the first and second cover layers 12, 14 advantageously prevents movement and "bunching up" of the intermediate layer 16 within the system 10, which would not be desirable. No further connections need to be made between the layers in such an embodiment of the simulated duvet cover system 10. Moreover as set forth in further detail below, the first cover layer 12 does not need to be directly coupled with the second cover layer 14, which reduces the overall assembly time.

Figure 4:
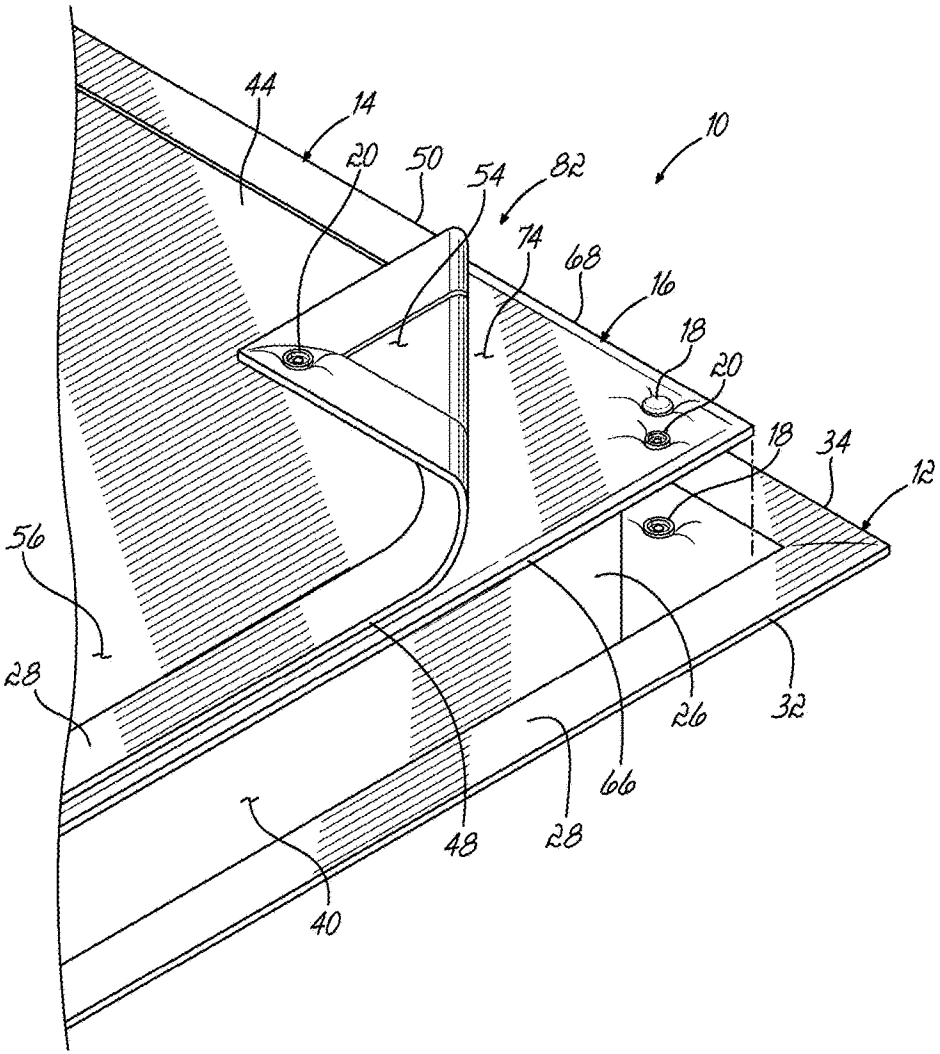
FIG. 4 is a detailed perspective view of one of the corner portions defined by the simulated duvet cover system as identified in detail 4 of FIG. 2, with the layers defining the simulated duvet cover system partially exploded to reveal fastening elements used to couple these layers together.
Figure 6:
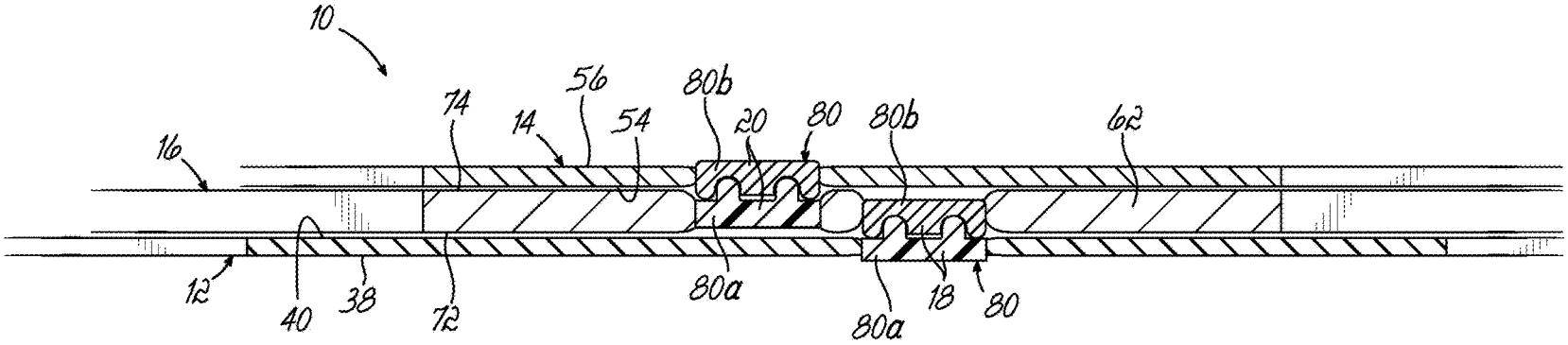
FIG. 6 is a side elevation cross-sectional view of one of the corner portions (similar to that shown in FIG. 4) of the simulated duvet cover system of FIG. 2, taken along line 6-6 in FIG. 2, with the fastening elements and the layers in an assembled position.

With specific reference to FIGS. 4 and 6, the arrangement of first and second fastening elements 18, 20 along the corner portions 82 at the bottom or foot end of the system 10 is shown in further detail. As a result of the intermediate layer 16 and the second cover layer 14 being the same size at these corner portions 82, the portions of the snap 80 defining the second fastening element 20 are arranged at the top surface 54 of the second cover layer 14 and at the bottom surface 74 of the intermediate layer 16. Thus, when the second fastening element 20 is moved to an engaged position shown in FIG. 6, the second fastening element 20 couples the top surface 54 of the second cover layer 14 and the bottom surface 74 of the intermediate layer 16 to one another at these corner portions 82. Although the first cover layer 12 is larger in size than the other layers at these corner portions 82, this larger size is configured to overlie the intersection of layers to hide that intersection, rather than wrapping around the edges thereof. Accordingly, the portions of the snap 80 defining the first fastening element 18 are arranged at the top surface 72 of intermediate layer 16 and at the bottom surface 40 of first cover layer 12. As such, when the first fastening element 18 is moved to an engaged position shown at FIG. 6, the first fastening element 18 couples the top surface 72 of intermediate layer 16 and the bottom surface 40 of first cover layer 12 to one another at the corner portions 82. Therefore, at the two corner portions 82 located adjacent to the foot end edges 32, 48, 66 of the layers, the first cover layer 12 is directly coupled to the intermediate layer 16 (using first fastening elements 18) along an opposite side from where the intermediate layer 16 is directly coupled to the second cover layer 14 (using second fastening elements 20).

Figure 5:
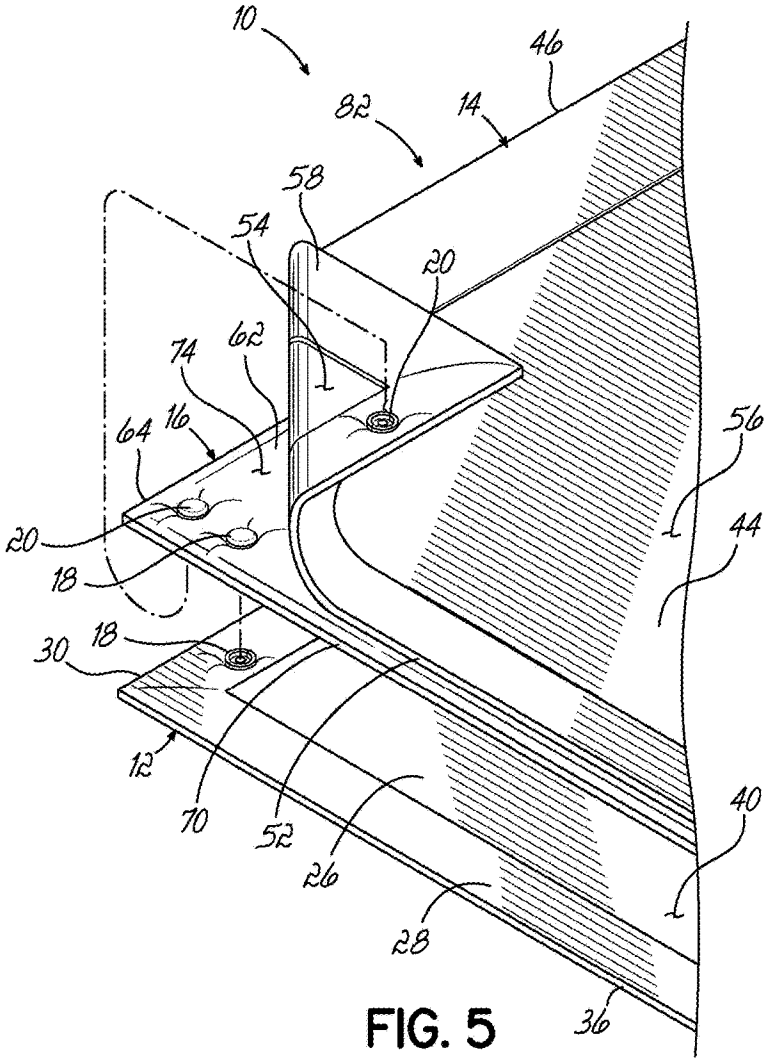
FIG. 5 is a detailed perspective view of another of the corner portions defined by the simulated duvet cover system as identified in detail 5 of FIG. 2, with the layers defining the simulated duvet cover system partially exploded to reveal fastening elements used to couple these layers together.
Figure 7:
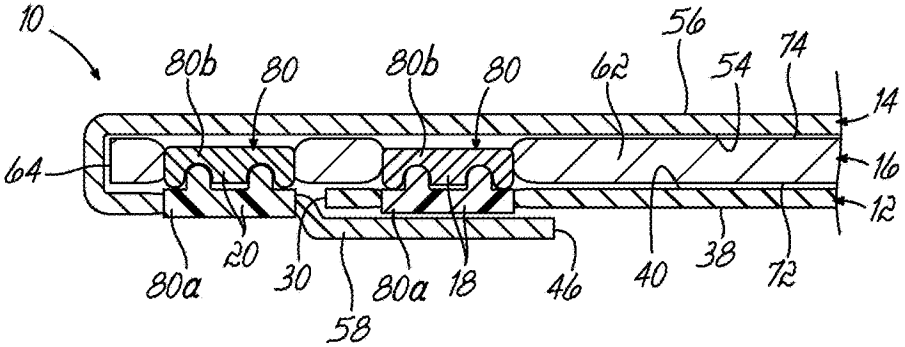
FIG. 7 is a side elevation cross-sectional view of one of the corner portions (similar to that shown in FIG. 5) of the simulated duvet cover system of FIG. 2, taken along line 7-7 in FIG. 2, with the fastening elements and the layers in an assembled position.

Turning with reference to FIGS. 5 and 7, the snaps 80 positioned along the other corner portions 82 and along the head end edges 30, 46, 64 of the layers are configured differently in this embodiment. As described above, the second cover layer 14 includes a flap portion 58 which is configured to wrap around the head end edges 30, 64 of the first cover layer 12 and the intermediate layer 16 when the system 10 is fully assembled, and as such, the snaps 80 defining the second fastening elements 20 are positioned on this flap portion 58 to assure that the second cover layer 14 remains wrapped around the head end edges as intended, including at these other two corner portions 82. To this end, when the second fastening element 20 at these locations is moved to the engaged position as shown in FIG. 7, the second fastening element 20 couples the top surface 54 of the second cover layer 14 (at flap portion 58) and the top surface 72 of the intermediate layer 16 to one another at these corner portions 82 and along the corresponding head end edges 46, 64. Also as shown in FIG. 7, when the first fastening element 18 at these locations is moved to the engaged position, the first fastening element 18 couples the top surface 72 of intermediate layer 16 and the bottom surface 40 of first cover layer 12 to one another at the corner portions 82 and along the corresponding head end edges 30, 64. Consequently, the first and second cover layers 12, 14 are directly coupled with the first and second fastening elements 18, 20 to a single same side of the intermediate layer 16 at these other two corner portions 82 and along the head end edges 30, 46, 64 of this embodiment.

Although not shown in the schematic cross-sections of FIGS. 6 and 7, it will be understood from FIGS. 1 through 5 that at least some of the snaps 80, defining portions of the first and second fastening elements 18, 20 which are located on the first and second cover layers 12, 14, are located within the double fabric sheet layers 28 located around the periphery of the first and second cover layers 12, 14. Of course, alternative double fabric sheet layers than those shown in the Figures may be added at locations adjacent the corner portions 82 to further stabilize the construction of these layers at the corner portions 82, while also providing pockets for receiving the snaps 80 (one of these is shown in FIG. 4, for example). As a result of being located on the innermost layer of the double fabric sheet layers 28 when the system 10 is fully assembled, the snaps 80 and the associated first and second fastening elements 18, 20 do not need to extend through an outermost surface on either side of the system (e.g., the top surface 38 of first cover layer 12 and the bottom surface 56 of second cover layer 14) and therefore do not need to be visible from the exterior of the system 10. One exception to the snaps 80 being located in the double fabric sheet layers 28 of the first and second cover layers 12, 14 is shown at the first fastening element 18 in the first cover layer 12 at FIG. 4, but as will be readily understood from FIG. 7, this snap 80 remains invisible after full assembly of the system 10 as a result of the flap portion 58 being positioned to overlie these snaps 80 as shown. It will be understood that the specific positioning of the snaps 80 and the double fabric sheet layers 28 may be modified in other embodiments.

Although not shown in the black and white copy of the Figures, the snaps 80 of the first fastening elements 18 may also be color-coded or otherwise made distinctive from the snaps 80 of the second fastening elements 20. In one example, all snaps 80 of the first fastening elements 18 are blue in color, while all snaps 80 of the second fastening elements 20 are white in color. Alternatively, the snaps 80 could be made different in one or more of size, shape, color, or other known visual or tactile factors which can be readily recognized by someone assembling the system 10. Such differentiation of the first and second fastening elements 18, 20 simplifies assembly of the simulated duvet cover system 10 because an operator will not accidentally connect a snap 80 from a first fastening element 18 onto a snap 80 from a second fastening element 20, which would lead to incorrect assembly and delay.

It should be appreciated that more or fewer of the first and second fastening elements 18, 20 may be provided in other embodiments, the locations thereof may be re-located altogether or adjusted up or down and/or left or right, as needed, and any one of the snaps 80 may be replaced or interchanged with a different type of fastener, while still retaining the overall benefits of the simulated duvet cover system 10. For example, while the first and second fastening elements 18, 20 have been discussed herein as snaps 80, buttons, and/or hook and loop closures (e.g., VELCRO®), other alternatives, such as magnets, clasps, and the like, may be considered, again, while still retaining the overall benefits of the system 10. Two such alternative embodiments are provided with reference to FIGS. 8 and 9, described below. Regardless of the particular fastener chosen, the first and second fastening elements 18, 20 advantageously enable easy and simple separate connection of the first cover layer 12 to the intermediate layer 16 and the second cover layer 14 to the intermediate layer 16, thereby enabling an assembly process which does not discourage periodic or frequent removal of the fabric sheet layers for cleaning. Additionally, the intermediate layer 16 defined by the blanket/comforter 62 is securely held in position and cannot move within the first and second cover layers 12, 14 in this embodiment, which is a benefit not provided by conventional duvet cover designs where the first and second cover layers 12, 14 are the only layers connected to each other.

As alluded to above, the process for assembling the simulated duvet cover system 10 in accordance with this and other embodiments is simple and easy, requiring minimal time and frustration on the part of the assembling person. The assembly method begins by laying the second cover layer 14 onto the bed 22 or another generally flat surface, and then laying the intermediate layer 16 on top of the second cover layer 14. The second cover layer 14 and the intermediate layer 16 are removably coupled to one another by using the second fastening elements 20 and connecting the snaps 80 together at the corner portions 82 and along the corresponding head end edges 46, 64. The method of assembly also includes laying the first cover layer 12 on top of the intermediate layer 16. The first cover layer 12 and the intermediate layer 16 are removably coupled to one another by using the first fastening elements 18 and connecting the snaps 80 together at the corner portions 82 and along the corresponding head end edges 30, 64. After the first and second fastening elements 18, 20 are moved to the engaged position or coupled together, the assembly of the simulated duvet cover system 10 is complete. It will be understood that all three of the layers 12, 14, 16 can be laid out in sequence before connecting any of the first and second fastening elements 18, 20, or the first cover layer 12 can be laid out after the other two layers are coupled together. The layers may be laid out and connected in the opposite order as well, so the particular order of the steps in the method of assembly is not deemed critical to achieving the benefits of the various embodiments described herein.

Thus, it can readily be appreciated that this laying out of layers and snapping together of fastening elements in the form of snaps 80 can be quickly accomplished to positively secure the intermediate layer 16 in an enclosed position sandwiched between fabric sheets of the first and second cover layers 12, 14. The snaps 80, even though limited to several select positions like the corner portions 82, effectively prevent movement of the intermediate layer 16 relative to the first and second cover layers 12, 14, which is a problem normally experienced with conventional designs. Those first and second cover layers 12, 14 are easily removable and replaceable for cleaning and other purposes, and the system 10 hides the appearance of substantially all of the first and second fastening elements 18, 20 and the interfaces of the layers (mostly as a result of the first cover layer 12 being larger in size than the other layers), so as to provide the desirable appearance of a conventionally-constructed duvet cover. Other options may be readily identified and used with this system 10, including having different decorative patterns on different first cover layers 12 to allow for different aesthetic appearances to be used on the bed 22, and/or including having a tracking system with identification elements such as barcodes or RFID chips included on the layers to track a number of laundering cycles, in contexts where that information is important to know, without departing from the scope of this disclosure.

Figure 8:
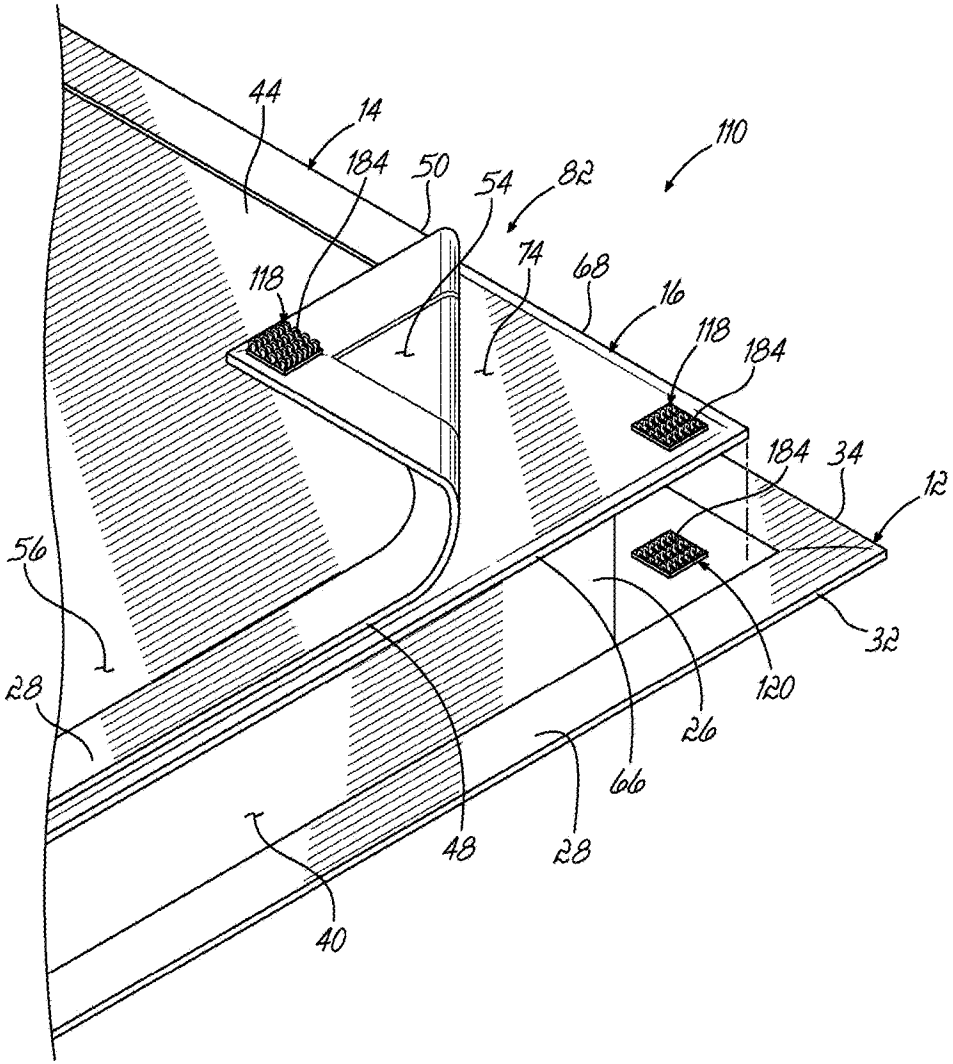
FIG. 8 is a detailed perspective view similar to FIG. 4 of one of the corner portions of the simulated duvet cover system in accordance with another embodiment of the invention, this embodiment including a different type of fastening element.

With reference to FIG. 8, one alternative embodiment of the simulated duvet cover system 110 is shown. This is a similar detailed view of a corner portion 82 as in FIG. 4 of the first described embodiment, and the same elements have been applied the same reference numbers without further comment or description herein. The difference in this embodiment of the system 110 is the use of hook and loop fastener panels 184 (e.g., such as VELCRO®) in place of the snaps 80 to define a different type of first fastening element 118 and second fastening element 120. The hook and loop fastener panels 184 may be sewn into position on the pertinent surfaces of the layers 12, 14, 16, or otherwise secured in position as known in the art. Once again, the hook and loop fastener panels 184 of the first fastening elements 118 may be differentiated in size, color, or some other visual/tactile manner from the second fastening elements 120 to simplify assembly of the system 110. However, the system 110 is assembled in exactly the same manner as the method described above, with the removable connection of the first and second cover layers 12, 14 to the intermediate layer 16 being made by hook and loop fastener closure rather than frictional snap engagement. The first and second cover layers 12, 14 of this embodiment continue to be removable for cleaning and then easily re-assembled for use on the bed 22, and the first and second fastening elements 118, 120 remain generally hidden from view during normal use on the bed 22 so as to provide the desirable appearance of a conventionally-fabricated duvet cover.

Figure 9:
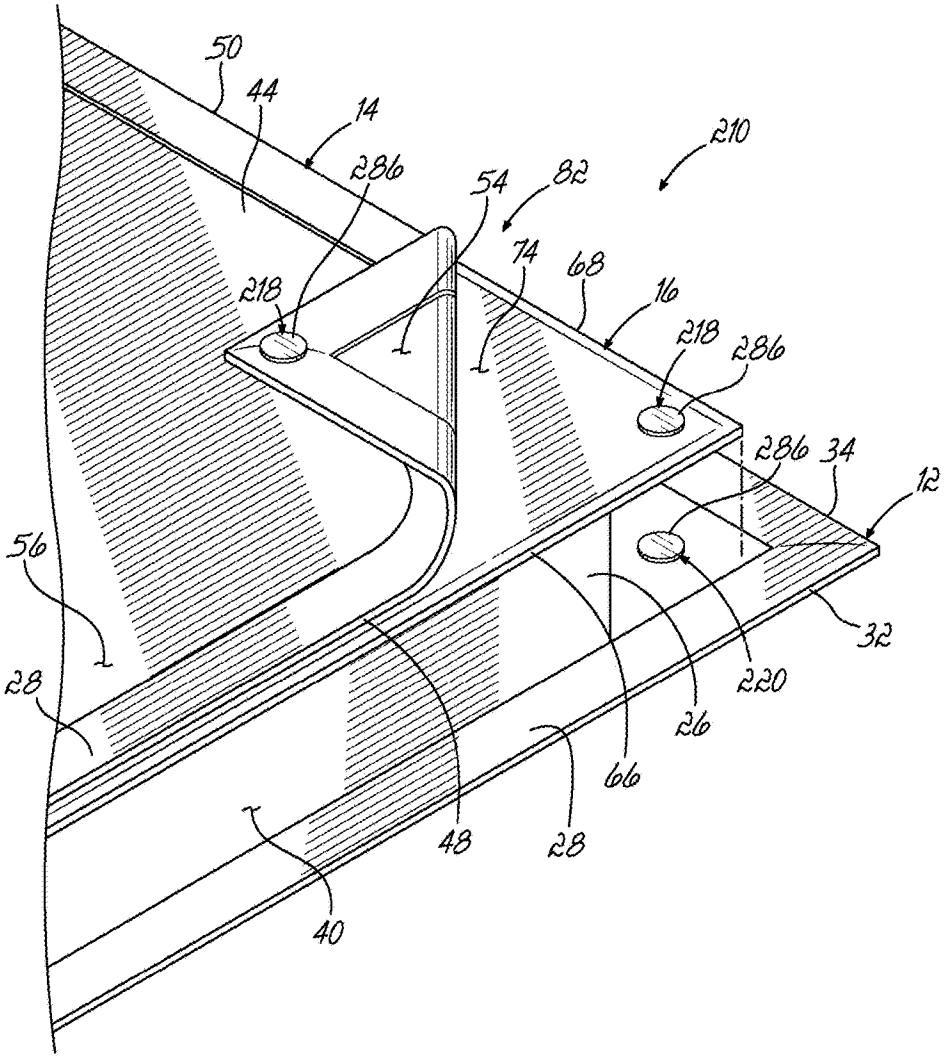
FIG. 9 is a detailed perspective view similar to FIG. 8 of one of the corner portions of the simulated duvet cover system in accordance with yet another embodiment of the invention, this embodiment including a different type of fastening element.

With reference to FIG. 9, another alternative embodiment of the simulated duvet cover system 210 is shown. This is a similar detailed view of a corner portion 82 as in FIG. 4 of the first described embodiment. The difference in this embodiment of the system 210 is the use of magnets 286 in place of the snaps 80 to define yet another different type of first fastening element 218 and second fastening element 220. The magnets 286 may be sewn or adhered into position on the pertinent surfaces of the layers 12, 14, 16, or otherwise secured in position as known in the art. Once again, the magnets 286 of the first fastening elements 218 may be differentiated in size, color, or some other visual/tactile manner from the second fastening elements 220 to simplify assembly of the system 210 (although this may not be required with the polarity inherent in coupling magnets). However, the system 210 is assembled in exactly the same manner as the method described above, with the removable connection of the first and second cover layers 12, 14 to the intermediate layer 16 being made by magnetic attraction rather than frictional snap engagement. The first and second cover layers 12, 14 of this embodiment continue to be removable for cleaning while also advantageously providing the desirable appearance of a conventionally-fabricated duvet cover.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A simulated duvet cover system for covering a bed, the system comprising:

a first cover layer defined by a first fabric sheet;

a second cover layer defined by a second fabric sheet;

an intermediate layer defined by at least one of a blanket or a comforter which is to be sandwiched between the first and second cover layers;

first fastening elements located at the first cover layer and the intermediate layer that removably couple the first cover layer to the intermediate layer; and second fastening elements located at the second cover layer and the intermediate layer that removably couple the second cover layer to the intermediate layer, the first cover layer being larger in size than each of the intermediate layer and the second cover layer such that intersections of all of the layers at the first and second fastening elements are hidden from view when the cover system is spread out on the bed with the intermediate layer sandwiched between the first and second cover layers and with the first cover layer located atop the system, and wherein the first and second cover layers are configured to be removed for cleaning separate from the intermediate layer, wherein the first and second cover layers are not directly coupled to one another.

2. The simulated duvet cover system of claim 1, wherein each of the first and second cover layers and the intermediate layer further comprises:

a head end edge configured to extend along a head end of the bed when the system is placed on the bed;

a foot end edge configured to extend along a foot end of the bed; and first and second side edges extending between the head end edge and the foot end edge.

3. The simulated duvet cover system of claim 2, wherein the first cover layer projects outwardly beyond the intermediate layer and the second cover layer at the corresponding foot end edges as well as the corresponding first and second side edges.

4. The simulated duvet cover system of claim 3, wherein the intermediate layer and the second cover layer are substantially the same size such that the corresponding foot end edges and the corresponding first and second side edges are positioned adjacent to each other when the intermediate layer and the second cover layer are coupled.

5. The simulated duvet cover system of claim 4, wherein the second cover layer further comprises:

a flap portion defining the head end edge of the second cover layer and which projects outwardly beyond the intermediate layer and the first cover layer at the corresponding head end edges, such that the flap portion extends around the head end edges of the first cover layer and the intermediate layer to hide from view intersections of all of the layers and first and second fastening elements located along the head end edges when the cover system is spread out on the bed.

6. The simulated duvet cover system of claim 2, wherein the first and second cover layers and the intermediate layer collectively define four corner portions at intersections of side edges and end edges, and wherein at two of the four corner portions, the first cover layer is directly coupled with the first fastening elements to an opposite side of the intermediate layer from where the second cover layer is directly coupled with the second fastening elements to the intermediate layer.

7. The simulated duvet cover system of claim 6, wherein at another two of the four corner portions, the first and second cover layers are directly coupled with the corresponding first and second fastening elements to a single same side of the intermediate layer.

8. The simulated duvet cover system of claim 7, wherein the first and second fastening elements couple the first and second cover layers to the intermediate layer at the four corner portions and also along the head end edges, with the first and second cover layers being directly coupled with the corresponding first and second fastening elements to the single same side of the intermediate layer at the head end edges.

9. The simulated duvet cover system of claim 8, wherein the second cover layer further comprises:

a flap portion which projects outwardly beyond the intermediate layer and the first cover layer at the corresponding head end edges, such that the flap portion extends around the head end edges of the first cover layer and the intermediate layer to hide from view intersections of all of the layers and first and second fastening elements located along the head end edges when the cover system is spread out on the bed.

10. The simulated duvet cover system of claim 2, wherein the first and second cover layers and the intermediate layer collectively define four corner portions at intersections of side edges and end edges, and wherein the first and second fastening elements are located at only the four corner portions and along the head end edges to couple each of the first and second cover layers to the intermediate layer only at these locations.

11. The simulated duvet cover system of claim 2, wherein each of the first and second cover layers is stitched to provide a double fabric sheet layer along at least some of the first and second side edges, the head end edge, and the foot end edge, and wherein at least some of the first and second fastening elements are secured within the double fabric sheet layer of the first and second cover layers to hide the first and second fastening elements from view when the cover system is spread out on the bed.

12. The simulated duvet cover system of claim 1, wherein the first and second fastening elements are defined by magnets.

13. The simulated duvet cover system of claim 1, wherein the intermediate layer includes insulating filler and is thicker in thickness than each of the first and second fabric sheets primarily defining the first and second cover layers.

14. The simulated duvet cover system of claim 1, wherein the first cover layer comprises a decorative pattern for covering the bed.

15. The simulated duvet cover system of claim 1, wherein the first and second fastening elements are defined by snaps.

16. The simulated duvet cover system of claim 15, wherein the snaps defining the first fastening elements are different in at least one of size, shape and color from the snaps defining the second fastening elements.

17. The simulated duvet cover system of claim 1, wherein the first and second fastening elements are defined by hook and loop fastener.

18. A simulated duvet cover system for covering a bed, the system comprising:

a first cover layer defined by a first fabric sheet;

a second cover layer defined by a second fabric sheet;

an intermediate layer defined by at least one of a blanket or a comforter which is to be sandwiched between the first and second cover layers;

first fastening elements located at the first cover layer and the intermediate layer that removably couple the first cover layer to the intermediate layer; and second fastening elements located at the second cover layer and the intermediate layer that removably couple the second cover layer to the intermediate layer, the first cover layer being larger in size than each of the intermediate layer and the second cover layer such that intersections of all of the layers at the first and second fastening elements are hidden from view when the cover system is spread out on the bed with the intermediate layer sandwiched between the first and second cover layers and with the first cover layer located atop the system, and wherein the first and second cover layers are configured to be removed for cleaning separate from the intermediate layer, wherein each of the first and second cover layers and the intermediate layer further comprises:

a head end edge configured to extend along a head end of the bed when the system is placed on the bed;

a foot end edge configured to extend along a foot end of the bed; and first and second side edges extending between the head end edge and the foot end edge, wherein the second cover layer further comprises:

a flap portion defining the head end edge of the second cover layer and which projects outwardly beyond the intermediate layer and the first cover layer at the corresponding head end edges, such that the flap portion extends around the head end edges of the first cover layer and the intermediate layer to hide from view intersections of all of the layers and first and second fastening elements located along the head end edges when the cover system is spread out on the bed.

19. A method for covering a bed with a simulated duvet cover system, the method comprising:

laying a second cover layer defined by a second fabric sheet onto the bed;

laying an intermediate layer defined by at least one of a blanket or a comforter on top of the second cover layer;

removably coupling the second cover layer to the intermediate layer using second fastening elements located at the second cover layer and the intermediate layer;

laying a first cover layer defined by a first fabric sheet on top of the intermediate layer, the first cover layer being larger in size than each of the intermediate layer and the second cover layer; and removably coupling the first cover layer to the intermediate layer using first fastening elements located at the first cover layer and the intermediate layer, wherein the first and second cover layers are configured to be removed for cleaning separate from the intermediate layer, wherein the first and second cover layers are not directly coupled to one another.

* * * * *